US011932509B2

(12) United States Patent
Nishigaki et al.

(10) Patent No.: US 11,932,509 B2
(45) Date of Patent: Mar. 19, 2024

(54) CONVEYER AND IMAGE RECORDING APPARATUS

(71) Applicant: BROTHER KOGYO KABUSHIKI KAISHA, Nagoya (JP)

(72) Inventors: Yuji Nishigaki, Nagoya (JP); Teruhito Hasegawa, Nagoya (JP); Yuri Morishita, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 219 days.

(21) Appl. No.: 17/533,602

(22) Filed: Nov. 23, 2021

(65) Prior Publication Data

US 2022/0169462 A1 Jun. 2, 2022

(30) Foreign Application Priority Data

Nov. 27, 2020 (JP) ..... 2020-196573

(51) Int. Cl.
*B65H 5/06* (2006.01)
*B65H 5/36* (2006.01)
*B65H 7/02* (2006.01)

(52) U.S. Cl.
CPC ..... *B65H 5/06* (2013.01); *B65H 5/36* (2013.01); *B65H 7/02* (2013.01)

(58) Field of Classification Search
CPC ..... B65H 5/36; B65H 26/02
See application file for complete search history.

(56) References Cited

U.S. PATENT DOCUMENTS 9,550,646 B2 * 1/2017 Horaguchi ..... B41J 15/165
2011/0246127 A1 * 10/2011 Schnabel ..... B65H 23/192 702/145
2012/0312855 A1 * 12/2012 Horaguchi ..... B41J 15/005 226/42
2015/0175374 A1 6/2015 Horaguchi

FOREIGN PATENT DOCUMENTS

JP 2011-143997 A 7/2011
JP 2015-117125 A 6/2015

* cited by examiner

*Primary Examiner* — Howard J Sanders
(74) *Attorney, Agent, or Firm* — Merchant & Gould P.C.

(57) ABSTRACT

A conveyer includes: a supporting member which supports a roll body having a sheet wound therearound; a conveyance roller which conveys the sheet; a guide member; an urging member which urges the guide member; a sensor; and a controller. The controller is configured: to determine a target position of the guide member and a permissible position in accordance with the target position; to control a rotation amount of the supporting member and/or a rotation amount of the conveyance roller; to determine whether or not a position of the guide member exceeds the permissible position; and to perform a notification of a conveying error of the sheet.

8 Claims, 12 Drawing Sheets

| TABLE | |
|---|---|
| RANGE OF DIAMETER OF ROLL BODY 211 | TARGET POSITION TP |
| A | a |
| B | b |
| ⋮ | ⋮ |

CONVEYER AND IMAGE RECORDING APPARATUS

CROSS REFERENCE TO RELATED APPLICATIONS

The present application claims priority from Japanese Patent Application No. 2020-196573, filed on Nov. 27, 2020, the disclosure of which is incorporated herein by reference in its entirety.

BACKGROUND

Description of the Related Art

There is a conventionally known conveyer used in a rolled paper printer and configured to convey a rolled paper sheet (rolled paper). In a certain publicly known conveyer is provided with a tensioner which is arranged in a conveying path for the rolled paper sheet, at a location between a storing part for the rolled paper sheet and a conveyance roller, and which is movable following any variation in the tension acting on the rolled paper sheet. A controller of the conveyer controls the rotation amount(s) of the conveyer roller and/or the rolled paper sheet so that the tensioner is located at a target portion in a movable range of the tensioner. Further, in a case that the tensioner continues to remain in an error area inside the movable range, the controller determines that any conveying error of the rolled paper sheet has occurred.

SUMMARY

In the rolled paper printer, in a case that the diameter of the rolled paper sheet is changed due to printing, a conveying route for the rolled paper sheet between the storing part and the tensioner is changed. As a result, the tensioner is moved by the rolled paper sheet, and the target position of the tensioner is changed. In the rolled paper printer, however, the error area is fixed, and thus the change in the diameter of the roller paper sheet might lead to such a fear that a conveying error might be wrongly (erroneously) determined.

The present disclosure has been made in view of the above-described situation, and an object of the present disclosure is to provide a technique capable of suppressing any erroneous determination of the conveying error in a conveyer which changes the target position of the tensioner.

According to an aspect of the present disclosure, there is provided a conveyer including: a supporting member, a conveyance roller, a guide member, an urging member, a sensor and a controller. The supporting member is configured to rotate in a state that the supporting member supports a roll body in which a roll sheet is wound. The conveyance roller is configured to convey the sheet pulled from the roll body in a conveying orientation. The guide member is positioned upstream in the conveying orientation of the conveyance roller, is configured to make contact with the sheet pulled from the roll body, and is configured to move in a crossing direction crossing an axis of the supporting member and an axis of the conveyance roller. The urging member is configured to urge the guide member in an urging direction including a component in the crossing direction so as to apply a tension to the sheet making contact with the guide member. The sensor is configured to detect a position in the crossing direction of the guide member. The controller is configured to control rotation of the supporting member and rotation of the conveyance roller. The controller is configured to execute: determination of a target position in the crossing direction of the guide member in accordance with a diameter of the roll body, and determination of a permissible position in accordance with the determined target position; controlling of a rotation amount of the supporting member, a rotation amount of the conveyance roller, or both of the rotation amount of the supporting member and the rotation amount of the conveyance roller so that the position in the crossing direction of the guide member, becomes to be the determined target position; determination as to whether or not the position in the crossing direction of the guide member detected by the sensor exceeds the permissible position; and performing of a notification of a conveying error of the sheet in accordance with determination by the controller that the position in the crossing direction of the guide member exceeds the permissible position.

The present disclosure contribute to suppression of any erroneous determination of the conveying error in the conveyer which changes the target position of the tensioner.

DETAILED DESCRIPTION

In the following, an image recording apparatus 100 and a conveyer 200 according to an embodiment of the present disclosure will be explained. Note that the embodiment is merely an example of the present disclosure, and it is needless to say that the embodiment may be changed as appropriate in a range not changing the gist of the present disclosure.

Figure 1:
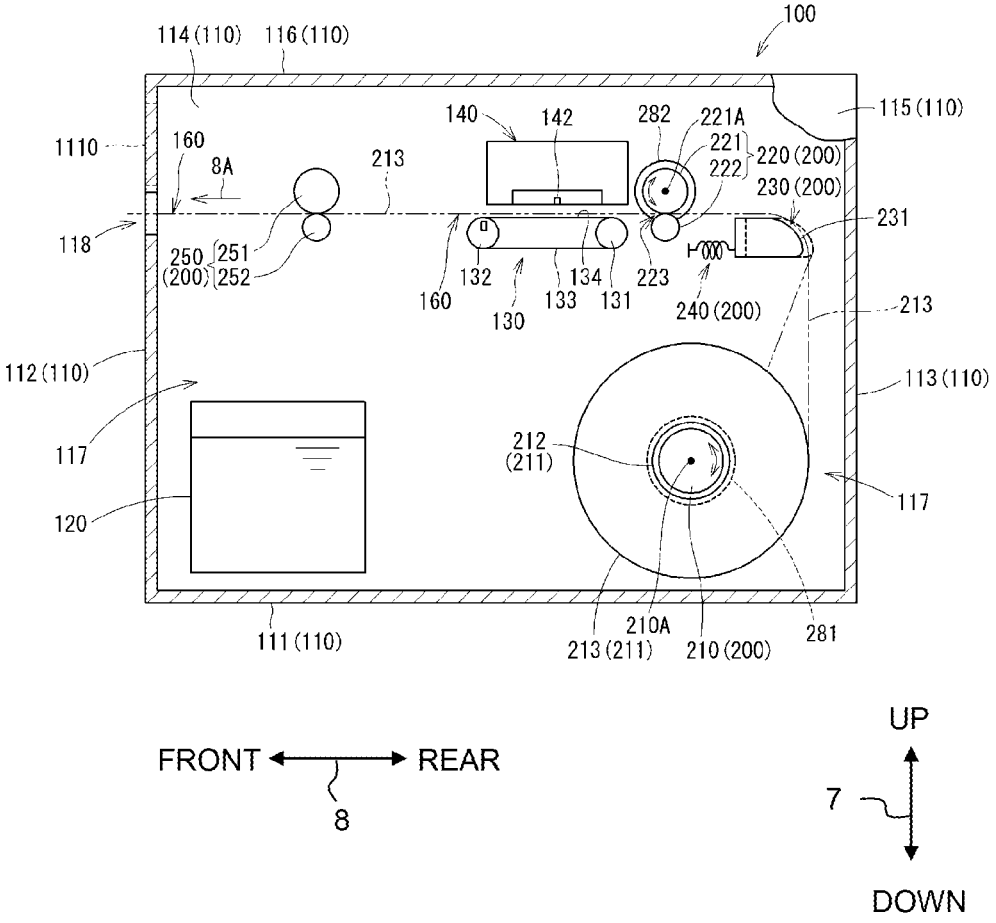
FIG. 1 is a schematic view depicting the configuration of an image recording apparatus 100 provided with a conveyer 200.

As depicted in FIG. 1, etc., an up-down direction 7 is defined, with a state in which the image recording apparatus 100 is installed usably (a state of FIG. 1), as the reference; a front-rear direction 8 is defined, with a side on which a discharge port 118 is provided being defined as a front side; and a left-right direction 9 is defined, with the image recording apparatus 10 as seen from the front side.

Configuration of Outer Appearance of Image Recording Apparatus 100

The image recording apparatus 100 as depicted in FIG. 1 is a label printer and records, in the ink-jet recording system, an image on a sheet 213 forming a roll body 211. The image recording apparatus 100 is usable in a state of being placed on the table or desk, on a floor surface or a rack.

Casing 110

The image recording apparatus 100 includes a casing 110 having a substantially rectangular parallelepiped shape. The casing 110 has, as a plurality of walls, a bottom wall 111, a front wall 112, a rear wall 113, a left wall 114, a right wall 115 and an upper wall 116. The plurality of walls partition an internal space 117 of the casing 110 from the outside. Note that most of the right wall 115 is omitted so as to indicate the internal configuration of the image recording apparatus 100.

A slit-shaped discharge port 118 which is long in the left-right direction 9 is formed in the front surface 112 at a location near to the upper end of the front surface 112. The sheet 213 on which the image recording has been performed is discharged from the discharge port 118.

An operation panel 1100 is provided on the front surface 112. The operation panel 1110 has an operation button and/or a display. A user operates the operation button in order to operate the image recording apparatus 100 and/or to confirm a variety of kinds of settings. The display displays a variety of kinds of information under the control of a controller 290.

Internal Configuration of Image Recording Apparatus 100, Configuration of Conveyer 200

Figure 2:
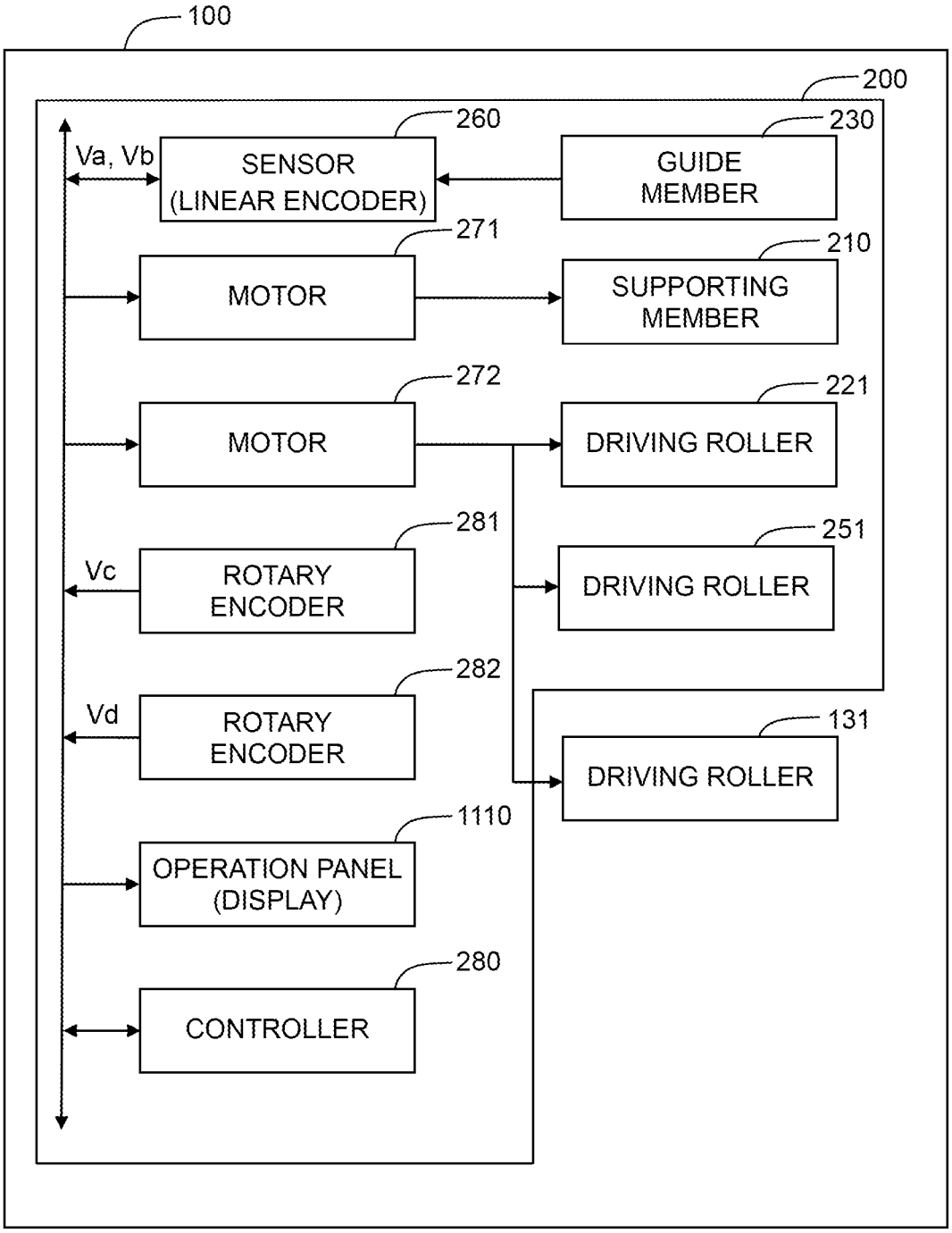
FIG. 2 is a block diagram of the image recording apparatus 100 and the conveyer 200.

The image recording apparatus 100 is provided with, in the internal space 117, the conveyer 200, a tank 120, a conveying/supporting mechanism 130 and a recording head 140. The conveyer 200 is provided with a supporting member 210, a conveyance roller pair 220, a guide member 230, an urging member 240 and a discharge roller pair 250. As depicted in FIG. 2, the image recording apparatus 100 is further provided with the operation panel 1110, a sensor 260, motors 271 and 272, rotary encoders 281 and 282, and the controller 290.

Support Member 210

In FIG. 1, the roll body 211 is accommodated in the internal space 117. The roll body 211 has a core tube 212 having a cylindrical tubular shape and the sheet 213 which is long. The sheet 213 is wound around the core tube 212. The sheet 213 is constructed of a separator and a plurality of labels. In the separator, the plurality of labels are adhered one by one with a spacing distance therebetween from a forward end of the separator.

Note that it is allowable that the roll body 211 does not have the core tube 212, and that the sheet 213 is wound in a roll shape so as to form the roll body 211.

In FIG. 1, the supporting member 210 extending in the left-right direction 9 is positioned at a location which is near to a rear end and near to a lower end of the internal space 117. The supporting member 210 is supported by a side frame (not depicted in the drawings) in the inside of the casing 110, at one end in the left-right direction 9 of the supporting member 210. The supporting member 210 has a rotation axis 210A which is parallel to the left-right direction 9, and is rotatable in the circumferential direction of the rotation axis 210A. A motive power generated by the motor 271 (see FIG. 2) is transmitted to the supporting member 210. The supporting member 210 is rotated by this motive power. Note that during execution of the image recording (see FIGS. 4A and 4B), the supporting member 210 rotates in a counterclockwise orientation in FIG. 1.

The roll body 211 is installed in the supporting member 210 having the above-described configuration. At the time of installment, the core tube 212 is inserted into the supporting member 210. As a result, the axial core of the core tube 212 is substantially coincident with the rotation axis 210A. Further, the left-right center of the sheet 213 is positioned along a center surface (see FIG. 3A) in the left-right direction 9 of a conveying route 160. In the following, unless specifically noted, the term "roll body 211" means a roll body 211 installed in the supporting member 210. The roll body 211 rotates together with the rotation of the supporting member 210. As a result, the sheet 213 wound around the roll body 211 is fed upward.

Conveyance Roller Pair 220

The conveyance roller pair 220 (an example of a "conveyance roller") is positioned to be away from the supporting member upward and away from the rear wall 113 frontward. The conveyance roller pair 220 has a driving roller 221 and a driven roller 222. The driving roller 221 is supported by each of a pair of side frames (not depicted in the drawings) to be rotatable in the circumferential direction of a rotation axis 221A of the driving roller 221. The driven roller 222 is, for example, a pinch roller, and is supported by each of the pair of side frames to be rotatable in the circumferential direction of a rotation axis of the driven roller 222. The driven roller 222 makes contact with a lower end of the driving roller 221 from therebelow. In the following, a contact part at which the driving roller 221 and the driven roller 222 make contact with each other is referred also to as a nip 223. A position in the up-down direction 7 of the nip 223 is substantially same with a position in the up-down direction 7 of the discharge port 118.

The conveyance roller pair 220 having the above-described configuration pinches or sandwiches the sheet 213, extending from the guide member 230, by the nip 223. A motive power generated by the motor 272 (see FIG. 2) is transmitted to the driving roller 221. The driving roller 221 is rotated by this motive power in the circumferential direction of the rotation axis 221A. The driven roller 222 follows the rotation of the driving roller 221 and rotates. As a result, the conveyance roller pair 220 feds the sheet 213 from the nip 223 in a conveying orientation 8A. The conveying orientation is a frontward orientation (frontward).

Note that the driving roller 221 and the driven roller 222 may be arranged so that the driven roller 222 makes contact with an upper end of the driving roller 221 from thereabove.

Discharge Roller Pair 250

The discharge roller pair 250 is positioned to be away from the conveyance roller pair 220 frontward. The discharge roller pair 250 has a driving roller 251 and a driven roller 252. The driving roller 251 and the driven roller 252 are each supported by each of a pair of side frames (not depicted in the drawings) to be rotatable in the circumferential direction of a rotation axis of each of the driving roller 251 and the driven roller 252. The driven roller 252 is, for example, a spur, and makes contact with a lower end of the driving roller 251 from therebelow; the driven roller 252 follows the rotation of the driving roller 251 and rotates. The driving roller 251 and the driven roller 252 make contact with each other at a position in the up-down direction 7 which is substantially same with the position in the up-down direction 7 of the discharge port 118.

The discharge roller pair 250 pinches or sandwiches the sheet 213 fed from the conveyance roller pair 220 and feds the sheet 213 in the conveying orientation 8A. The sheet 213 is discharged from the discharge port 118.

Guide Member 230, Urging Member 240

Figure 3A:
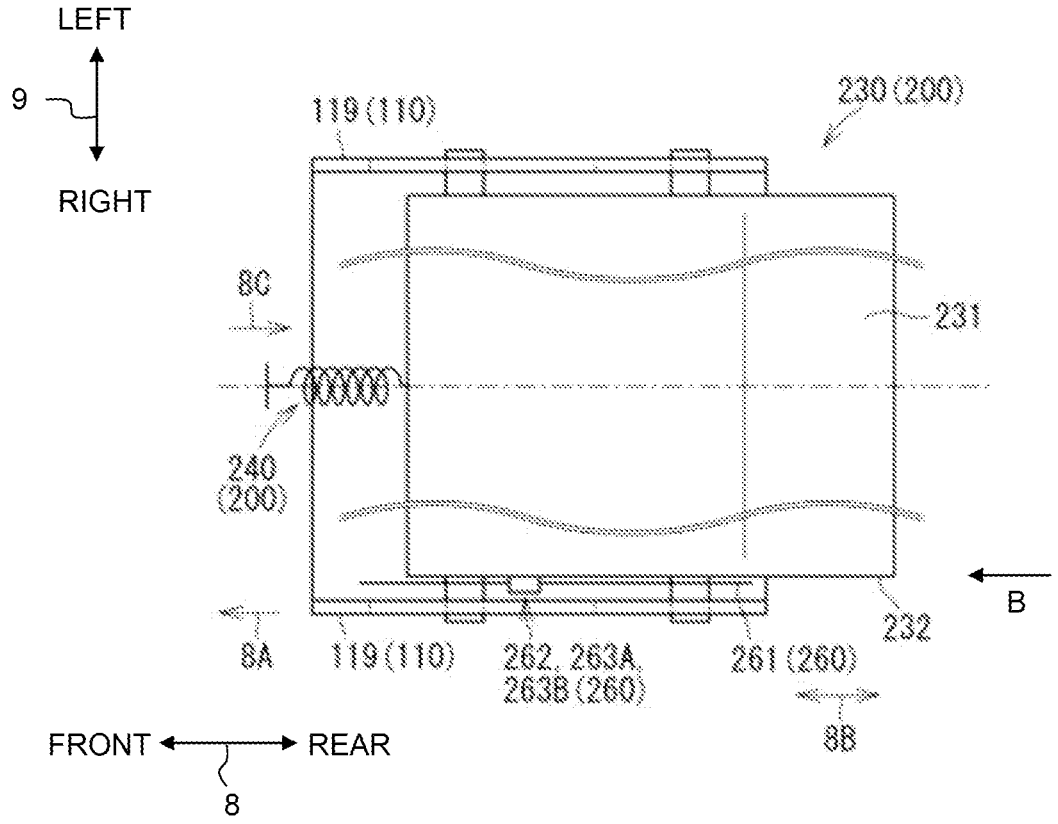
FIGS. 3A, 3B and 3C are schematic views depicting the detailed configurations of a guide member 230, an urging member 240 and a sensor 260.

In FIG. 1, the guide member 230 is positioned to be away from the supporting member 210 upward in the up-down direction 7. The guide member 230 is positioned between the rear wall 113 and the conveyance roller pair 220 in the front-rear direction 8. Further, as depicted in FIG. 3A, the guide member 230 extends between a pair of side frames 119 inside the casing 110. A right end and a left end of the guide member 230 are supported by the pair of side frames 119.

Figures 5A, 5B:
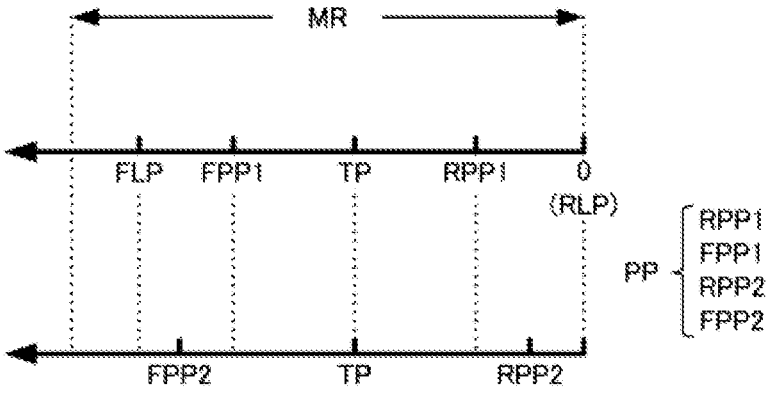
FIG. 5A is a schematic view indicating the content of a table 281.
FIG. 5B is a schematic view indicating the relationship between a target position TP and a permissible position PP in a movable range MR.

In FIG. 3A, the guide member 230 is supported by the pair of side frames 119 to be movable in a movable direction 8B within a movable range MR (see FIG. 5B). The movable direction 8B is a direction crossing both the rotation axis 210A and the rotation axis 221A (see FIG. 1). The movable direction 8B is an example of a "crossing direction". In the present embodiment, the movable direction 8B is parallel to the front-rear direction 8. Note that, however, the movable direction 8B is not limited to or restricted by this. It is allowable that the movable direction 8B is inclined with respect to the front-rear direction 8. Note that in the following description, a limited position on the rear side and a limit position on the front side to which the guide member 230 is movable in the movable range MR are referred also to as a "rear limit position RLP" and a "front limit position FLP" (see FIG. 5B), respectively.

In FIGS. 1 and 3A, the guide member 230 has a curved surface 231 which is oriented to the outside of the casing 110 (specifically, toward the rear wall 113 and toward the upper wall 116). An upper end of the curved surface 231 is at a position which is substantially same as the nip 223 in the up-down direction 7. The upper end of the curved surface 231 is a flat surface expanding in the front-rear direction 7 and the left-right direction 9. A part or portion, of the curved surface 231, which connects a rear end portion of the upper end and a rear end portion (or "a front end portion"?) of the lower end of the curved surface 231 swells in an arc shape toward the outside of the casing 110 (specifically, toward a rearward and obliquely upward direction), in a plane view form the left-right direction 9.

As depicted in FIG. 1, the sheet 213 pulled out or drawn from the roll body 211 is placed on the curved surface 231 having the above-described configuration. The sheet 231 makes contact with the curved surface 231, is guided along the curved surface 231 and changes the orientation thereof toward the nip 223.

In FIGS. 1 and 3A, the urging member 240 is a compressed spring, and extends in the front-rear direction 8 between the guide member 230 and a frame (not depicted in the drawings) inside the casing 110. A front end of the urging member 240 is connected to the frame at a position in front of the guide member 230. The urging member 240 extends in the front-rear direction 8. A rear end of the urging member 240 is connected to the guide member 230.

The urging member 240 applies a force in an urging orientation 8C (hereinafter referred also to as an "urging force") to the guide member 230, as depicted in FIG. 3A. The urging orientation 8C is a direction including a component in the movable direction 8B. In the present embodiment, the urging orientation 8C is parallel to the movable direction 8B and the front-rear direction 8.

Note that in the following description, a combination of the guide member 230 and the urging member 240 is referred also to as a "tensioner".

Conveying Route 160

As depicted in FIG. 1, the conveying route 160 starting from the nip 223 and reaching up to the discharge port 118 is formed in the internal space 117. The conveying route 160 is a space which extends substantially linearly along the conveying orientation 8A and via which the sheet 213 is passable. The conveying route 160 is defined by the conveying/supporting mechanism 130 and the recording head 140 which are located to be apart from each other in the up-down direction 7, etc.

Tank 120

The tank 120 stores an ink at a position close to the front end of the internal space 117 and below the conveying route 160. The ink inside the tank 120 is supplied to the recording head 140 via a non-illustrated tube.

Recording Head 140

The recording head 140 is positioned between the conveyance roller pair 220 and the discharge roller pair 250 in the front-rear direction 8. The recording head 140 is located at a position slightly above the conveying route 160 in the up-down direction 7. At this position, the recording head 140 discharges or ejects the ink in the inside thereof under the control of the controller 290.

Openings of a plurality of nozzles 142 are aligned in the left-right direction 9 in the lower surface of the recording head 140. Note that only one piece of the nozzle 142 is depicted in FIG. 1. Droplets of the ink (ink droplets) are discharged downward from the plurality of nozzles 142 toward the sheet 213 which passes (is passing) the conveying route 160. With this, an image is recorded on the sheet 213. Note that the plurality of nozzles 142 may be aligned in the front-rear direction 8 and the left-right direction 9 in the lower surface of the recording head 140.

Conveying/Supporting Mechanism 130

The conveying/supporting mechanism 130 is provided with a driving roller 131, a driven roller 132 and an endless belt 133. The driving roller 131 is positioned between the conveyance roller pair 220 and the plurality of nozzles 142 in the front-rear direction 8. The driven roller 132 is positioned between the plurality of nozzles 142 and the discharge roller pair 250 in the front-rear direction 8. A position in the up-down direction 7 of an upper end of each of the driving roller 131 and the driven roller 132 is slightly below the position in the up-down direction 7 of the conveying route 160. Note that the relationship of the positions in the front-rear direction 8 of the driving roller 131 and the driven roller 132 may be opposite to that described above. The endless belt 133 is stretched between the driving roller 131 and the driven roller 132. An upper end surface of the endless belt 133 is used as a conveying surface 134. The conveying surface 134 faces or is opposite to the plurality of nozzles 142, with the conveying route 160 being interposed therebetween.

The driving roller 131 rotates by the motive power generated by the motor 272 (see FIG. 2) and rotates the endless belt 133. The driven roller 132 rotates, accompanying with the rotation of the endless belt 133. During the execution of the image recording (see FIGS. 4A and 4B), the driving roller 131 rotates such that the conveying surface 134 is moved in the conveying orientation 8A. Further, the conveying surface 134 applies a force in the conveying orientation 8A (hereinafter referred also to as a "conveying force") to the sheet 213, while supporting the sheet 213 which is passing the conveying route 160 from therebelow.

Note that the conveying/supporting mechanism 130 may be configured to absorb the sheet 213.

Sensor 260

In FIG. 2, the sensor 260 detects a current position of the guide member 230 in the movable range MR. Specifically, the sensor 260 is a linear encoder of the transmission type, and has a strip 216, a light-emitting element 262 and at least two light-receiving elements 263A and 263B, as depicted in FIG. 3.

Here, FIG. 3A is also a schematic view depicting the configurations of the guide member 230 and the sensor 260. Further, FIG. 3B is a schematic view depicting the configuration of the sensor 260 as seen from a direction of an arrow B depicted in FIG. 3A (namely, seen from the rear side), and FIG. 3C is a schematic view depicting the configuration of the sensor 260 as seen from a direction of an arrow C depicted in FIG. 3B (namely, seen from the right side).

The strip 261 extends in the movable direction 8B at a position which is slightly on the right side with respect to the guide member 230, and is fixed to the frame (not depicted in the drawings) inside the casing 110. A main surface of the strip 261 faces or is opposite to a right side surface 232 of the guide member 230. As depicted in FIG. 3C, the strip 261 has, in the main surface thereof, an A-phase slit group 261A and a B-phase slit group 261B. The slit group 261B is formed at a position which is apart from the slit group 261A downward and slightly shifted to one side in the movable direction 8B (specifically, shifted rearward) with respect to the slit group 261A. Each of the slit groups 261A and 261B is formed of a plurality of slits which are aligned in the movable direction 8B with an equal spacing distance therebetween. The shapes of the respective slits are same to one another.

Figure 3B:
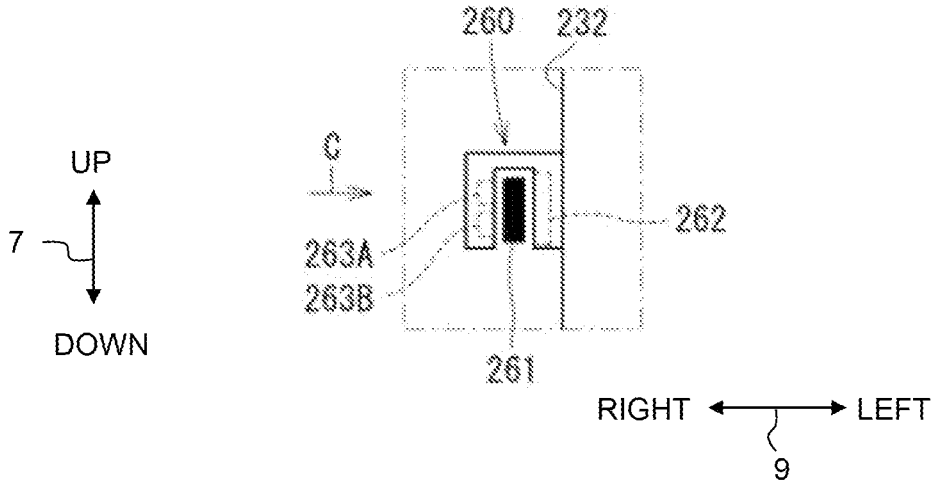
Figure 3C:
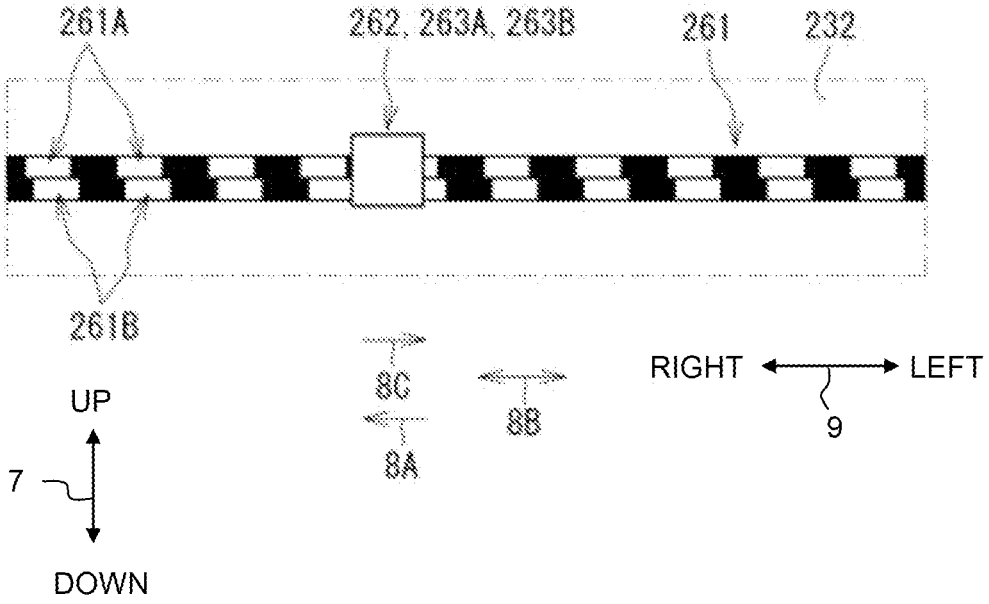

The light-emitting element 262 is fixed to the right side surface 232 so that the light-emitting element 262 faces the slit groups 261A and 261B at a position on the left side with respect to the strip 261, as depicted in FIG. 3B. At this position, the light-emitting element 262 emits a light toward the strip 261 under the control of the controller 290.

Each of the light-receiving elements 263A and 263B is fixed to the right side surface 232 so as to face the light-emitting element 262, with the strip 261 being interposed therebetween, at a position on the right side with respect to the strip 261. At this position, the light receiving elements 263A and 263B output, respectively, a signal Va and a signal Vb (see FIG. 2), each of which is in accordance with an incident light amount from the side of the strip 261, to the controller 290.

Rotary Encoders 281, 282

In FIG. 2, each of the rotary encoders 281 and 282 is a linear encoder of the transmission type; the rotary encoders 281 and 282 have encoder disks, light-emitting elements and light-receiving element, respectively.

Each of the encoder disks has slits having a same shape and formed therein in a circumferential direction of a rotation axis possessed thereby, with an equal spacing distance therebetween. The encoder disk of the rotary encoder 281 is attached to an end on one side in the left-right direction 9 of the supporting member 210 so that the rotation axis of the encoder disk is coincident with the rotation axis 210A. The encoder disk of the rotary encoder 282 is attached to an end on one side in the left-right direction 9 of the driving roller 221 so that the rotation axis of the encoder disk is coincident with the rotation axis 221.

Each of the light-emitting elements emits the light at a position facing the encoder disk of a same rotary encoder, between the rotary encoders 281 and 282, to which each of the light-emitting element belongs, under the control of the controller 290.

Each of the light-receiving elements is provided at a position at which each of the light-receiving elements faces the light-emitting element, with the encoder disk being interposed therebetween, the encoder disk being of a same rotary encoder, between the rotary encoders 281 and 282, to which the each of the light-receiving element belongs. The light-receiving element of the rotary encoder 281 outputs a signal Vc, corresponding to an incident light amount from the side of the encoder disk, to the controller 290. The light-receiving element of the rotary encoder 282 outputs a signal Vd, corresponding to an incident light amount from the side of the encoder disk, to the controller 290.

Controller 290, Motors 271 and 272

In FIG. 2, the controller 290 is provided with a CPU, a ROM, a RAM, an EEPROM and an ASIC which are electrically connected to one another with an internal bus. In the controller 290, the CPU executes a control program stored in the ROM, while using the RAM as a workspace. The control program is a program for allowing the CPU to control an operation of the image recording apparatus 100. The ASIC generates a driving signal for rotating each of the motors 271 and 272, under the control of the CPU, and outputs the driving signal to each of the motors 271 and 272.

Note that in the controller 290, it is allowable that only the CPU performs respective kinds of processing. Alternatively, it is allowable that only the ASIC performs the respective kinds of processing, or that the CPU and the ASIC perform the respective kinds of processing in a cooperative manner. Still alternatively, in the controller 290, it is allowable that one CPU singly performs the respective processing, or that a plurality of pieces of the CPU perform the processings in a sharing manner. Alternatively, in the controller 290, it is allowable that one ASIC singly performs the respective processing, or that a plurality of pieces of the ASIC perform the processings in a sharing manner.

Other Configurations

The image recording apparatus 100 is provided with a fixing unit, a maintenance unit, etc., which are not illustrated in the drawings. The fixing unit is a halogen heater which is elongated in the left-right direction 9, and is located at a position which is in front of the recording head 140 and which is above the conveying route 160. The fixing unit is configured to fix the ink to the sheet 213 by radiating an infrared light to the sheet 213 which is passing a location below the fixing unit. The maintenance unit includes a cap configured to cover the plurality of nozzles 142 possessed by the recording head 140, a wiper configured to wipe the lower surface of the recording head 140, etc.

Further, the conveyer 200 is not provided with a conveyance roller pair which applies the conveying force to the sheet which is being conveyed between the supporting member 210 and the guide member 230. Furthermore, the conveyer 200 is not provided with another guide member which applies the tension to the sheet which is being conveyed between the supporting member 210 and the guide member 230.

Operations of Image Recording Apparatus 100 and Conveyer 200

An operator of the image recording apparatus 100 attaches a new roll body 211 to the supporting member 210. Then, the operator pulls a forward end of the sheet 213 upward from the roll body 211. The sheet 213 is placed on the curved surface 231 of the guide member 230, and is curbed frontward. The forward end of the sheet 213 is pinched into the nip 223 of the conveyance roller pair 220. Afterwards, the image recording apparatus 100 stands by for a reception of image data, indicating an image to be recorded on each of the labels of the roll body 211, from an external personal computer, etc.

Figure 4A:
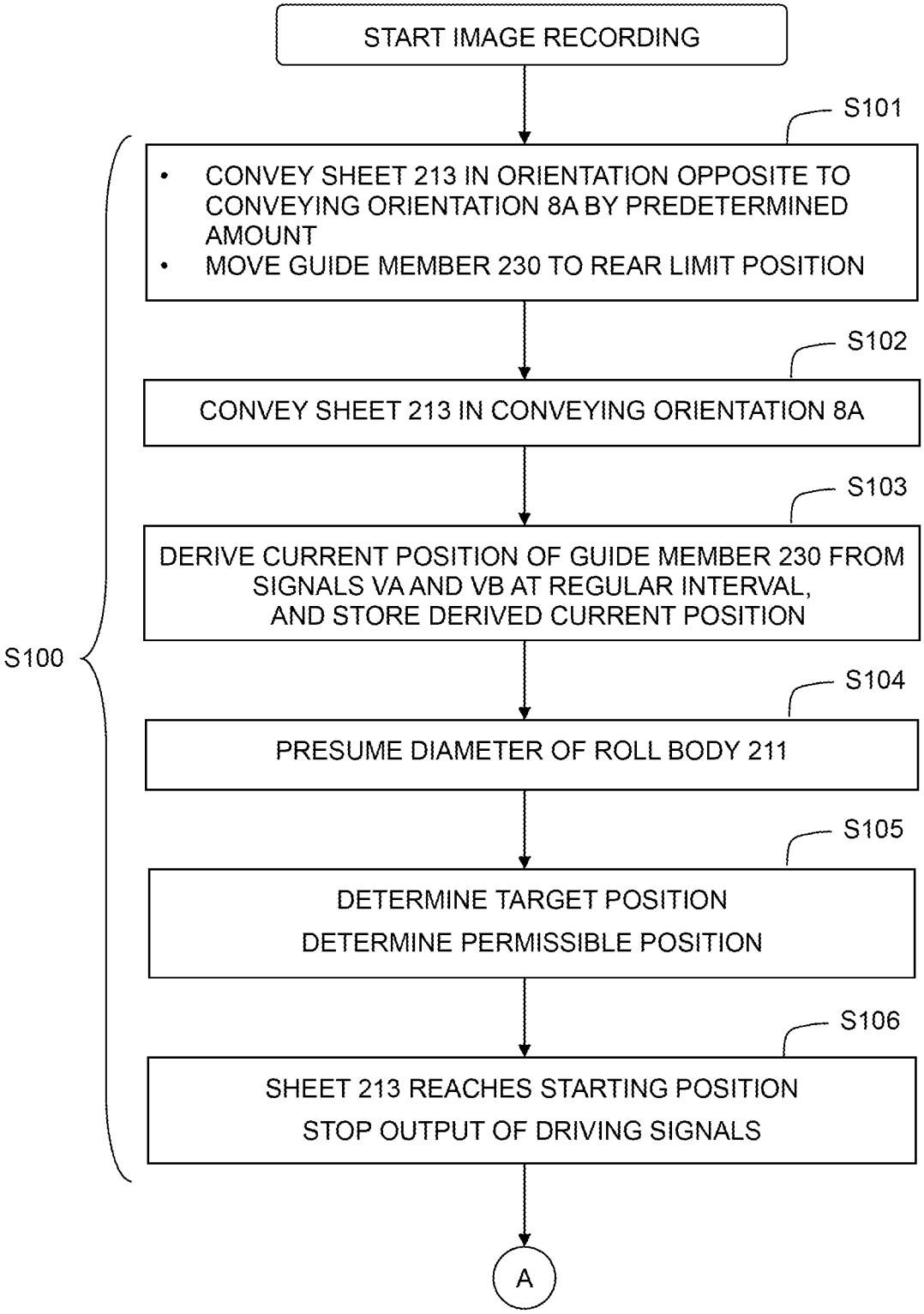
FIGS. 4A and 4B depict a flow chart indicating a processing procedure of an image recording in the image recording apparatus 100.

In accordance with the receipt of the image data, the controller 290 executes a preparing processing of an image recording (a processing of S100 of FIG. 4A). The preparing processing (namely, a processing of S100) includes processings of S101 to S106.

In the processing of S101, the controller 290 firstly provides the driving signal to the motor 272 to thereby rotate the driving rollers 221, 251 and 131 so that the sheet 213 on the conveying route 160 is conveyed in a reverse orientation to the conveying orientation 8A only by a predetermined amount. As a result, the sheet 213 is loosen in the surrounding of the guide member 230, and the guide member 230 is moved to the rear limit position RLP in the movable range MR. The rear limit position RLP is used as the origin of the position in the movable direction 8B of the guide member 230.

Next, in the processing of S102, the controller 290 provides the driving signal to the motor 271 to thereby rotate each of the supporting member 210 and the driving rollers 221, 251 and 131 so that the sheet 213 on the conveying route 160 is conveyed in the conveying orientation 8A. In this process, the sheet 213 applies a force in the conveying orientation 8A to the curved surface 231 of the guide member 230. Further, an urging force in the urging orientation 8C by the urging member 240 is also applied to the guide member 230, against the force in the conveying orientation 8A. With this, the tension is applied to the sheet 213. The guide member 230 changes the position thereof inside the movable range MR, in accordance with the tension.

In the processing of S103, the controller 230 starts obtainment of the signal Va from the light-receiving element 263A and obtainment of the signal Va from the light-receiving element 263B. The controller 290 derives the current position with respect to the origin, from the signals Va and Vb, at a constant time interval, and stores the derived current position. The current position is a current position of the guide member 230 in the movable direction 8B.

In the processing of S104, the controller 290 presumes, by a publicly known method, the diameter of the roll body 211 based on a conveying amount of the sheet 213, in a case of conveying the sheet 213 from the roll body 211 in the processing of S102, and a rotation amount in the circumferential direction of the supporting member 210. Specifically, after the state of the sheet 213 becomes to be a state with no loosening between the guide member 230 and the conveyance roller pair 220, the controller 290 obtains the signal Vd from the rotary encoder 282, and derives the rotation amount of the conveyance roller pair 220 based on the number of pulses included in the signal Vd. Based on the derived rotation amount of the conveyance roller pair 220 and a predetermined circumferential length of the driving roller 221, the controller 290 derives the conveying amount in the conveying orientation 8A of the sheet 213. The controller 290 obtains the signal Vc from the rotary encoder 281, and derives the rotation amount of the supporting member 210 from the number of pulses included in the signal Vc. The controller 290 presumes the diameter of the roll body 211 from the conveying amount of the sheet 213 and the rotation amount of the supporting member 210.

Note that regarding the method of presuming the diameter of the roll body 211, it is allowable to use another publicly known method, for example, such as using an optical sensor to thereby grasping (obtaining information regarding) the outer circumferential part of the roll body 211, etc., to thereby presume the diameter of the roll body 211.

The controller 290 stores, in the EEPROM, etc., a table 281 (see FIG. 5A) in which target positions TP of the guide member 230 are recorded each for one of ranges of the diameter of the roll body 211. In FIG. 5A, each of the target positions TP stored in the table 281 is a position in the movable range 8B with the origin as the reference, and is determined in the design/development stages of the image recording apparatus 100.

After the processing of S104, the controller 290 determines, in the processing of S105, the target position TP. Specifically, the controller 290 extracts a target position TP, among the target positions TP, which corresponds to the presumed diameter from the table 281, and stores the extracted target position TP in the RAM, etc.

In the processing of S105, the controller 290 further determines a set of a first rear-side permissible position RPP1 and a first front-side permissible position FPP1 (hereinafter referred also to as a "first permissible position set"), and a set of a second rear-side permissible position RPP2 and a second front-side permissible position FPP2 (hereinafter referred also to as a "second permissible position set"), as four permissible positions PP (see FIG. 5B), and stores the determined sets in the RAM, etc.

During the execution of the image recording, the controller 290 activates the motors 271 and 272 in accordance with a predetermined driving profile. By the driving profile, the rotations of the motors 271 and 272 accelerate until the rotations reach from the start of the rotations to the stationary state (namely, the constant speed). Further, the rotations of the motors 271 and 272 decelerate until the rotations reach from the stationary state to the stop of the rotations.

The first rear-side permissible position RPP1 and the first front-side permissible position FPP1 are used by the controller 290 in a case that the motors 271 and 272 are in the stationary state, and are positions which are apart from the target position TP only by a first distance to the rear side and the front side, respectively, in the movable direction 8B, as depicted in FIG. 5B. The first rear-side permissible position RPP1 is a position in front of the rear limit position RLP, and the first front-side permissible position FPP1 is a position behind the front limit position FLP.

The second rear-side permissible position RPP2 and the second front-side permissible position FPP2 are used by the controller 290 in a case that the rotations of the motors 271 and 272 are accelerating or decelerating, and are positions which are apart from the target position TP only by a second distance to the rear side and the front side, respectively, in the movable direction 8B, as depicted in FIG. 5B. The second distance is longer than the first distance. Accordingly, the second rear-side permissible position RPP2 is a position behind the first rear-side permissible position RPP1 and in front of the rear limit position RLP, and the second front-side permissible position FPP2 is a position in front of the first front-side permissible position FPP1 and behind the front limit position FLP. The first rear-side permissible position RPP1 and the first front-side permissible position FPP1 is an example of a "first permissible position", and the second rear-side permissible position RPP2 and the second front-side permissible position FPP2 is an example of a "second permissible position".

In the processing of S106. the controller 290 stops the output of the driving signals, in accordance with the arrival (reaching) of the sheet 213 at a start position of the image recording.

By the processings of S101 to S106, the sheet 213 stops at the start position, and the current position, the target position TP and the four permissible positions PP regarding the guide member 230 are stored in the RAM.

Next to the processing of S106, the controller 290 controls the respective parts or components of the image recording apparatus 100 for the image recording, by the processings of S107 to S109.

In the processing of S107, the controller 290 starts the output of the driving signals to the motors 271 and 272, respectively, in accordance with the driving profile. With this, the controller 290 starts to rotate each of the supporting member 210 and the driving rollers 221, 251 and 131 so as to convey the sheet 213 on the conveying route 160 in the conveying orientation 8A. Also in this process, the tension is applied to the sheet 213, and the guide member 230 moves in the front-rear direction 8 within the movable range MR.

In the processing of S108, the controller 290 causes the ink to be discharged from the plurality of nozzles 142, based on the image data. As a result, an image is recorded on a label of the sheet 213.

In the processing of S109, the controller 290 determines whether or not the image recording is to be ended. In a case that the controller 290 determines that the image recording is not to be ended (namely, NO in the processing of S109), the controller 290 executes the processing of S108 so as to continue the discharging of the ink. In a case that the controller 290 determines that the image recording is to be ended (namely, YES in the processing of S109), then in the processing of S110, the controller 290 stops the output of the driving signals to the motors 271 and 272, respectively, in accordance with the driving profile. Then, the controller 290 ends the processing of FIGS. 4A and 4B.

Figure 6A:
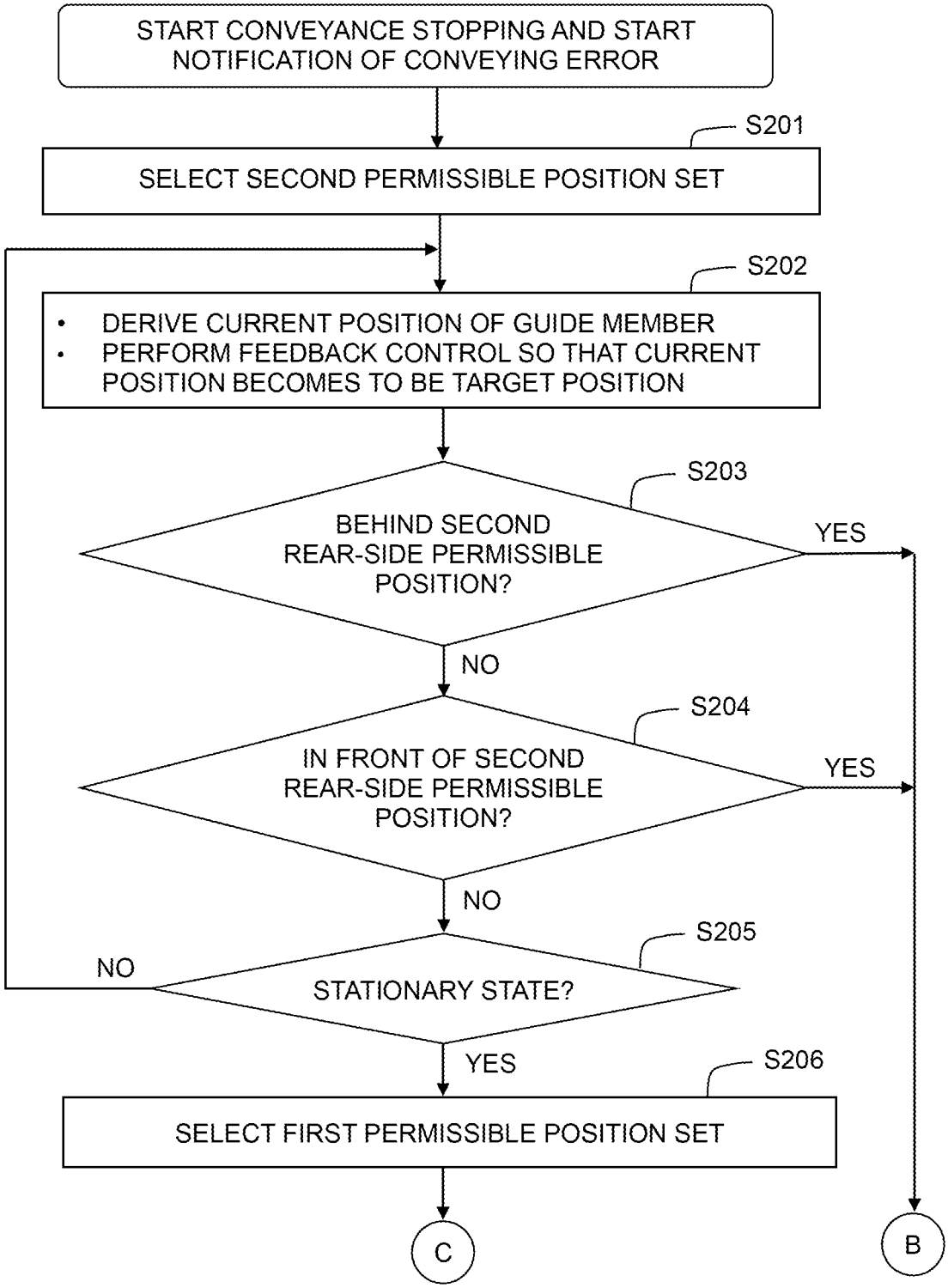
FIGS. 6A, 6B and 6C depict a flow chart indicating a processing procedure of conveyance stopping and notification of conveying error in the image recording apparatus 100.
Figure 6B:
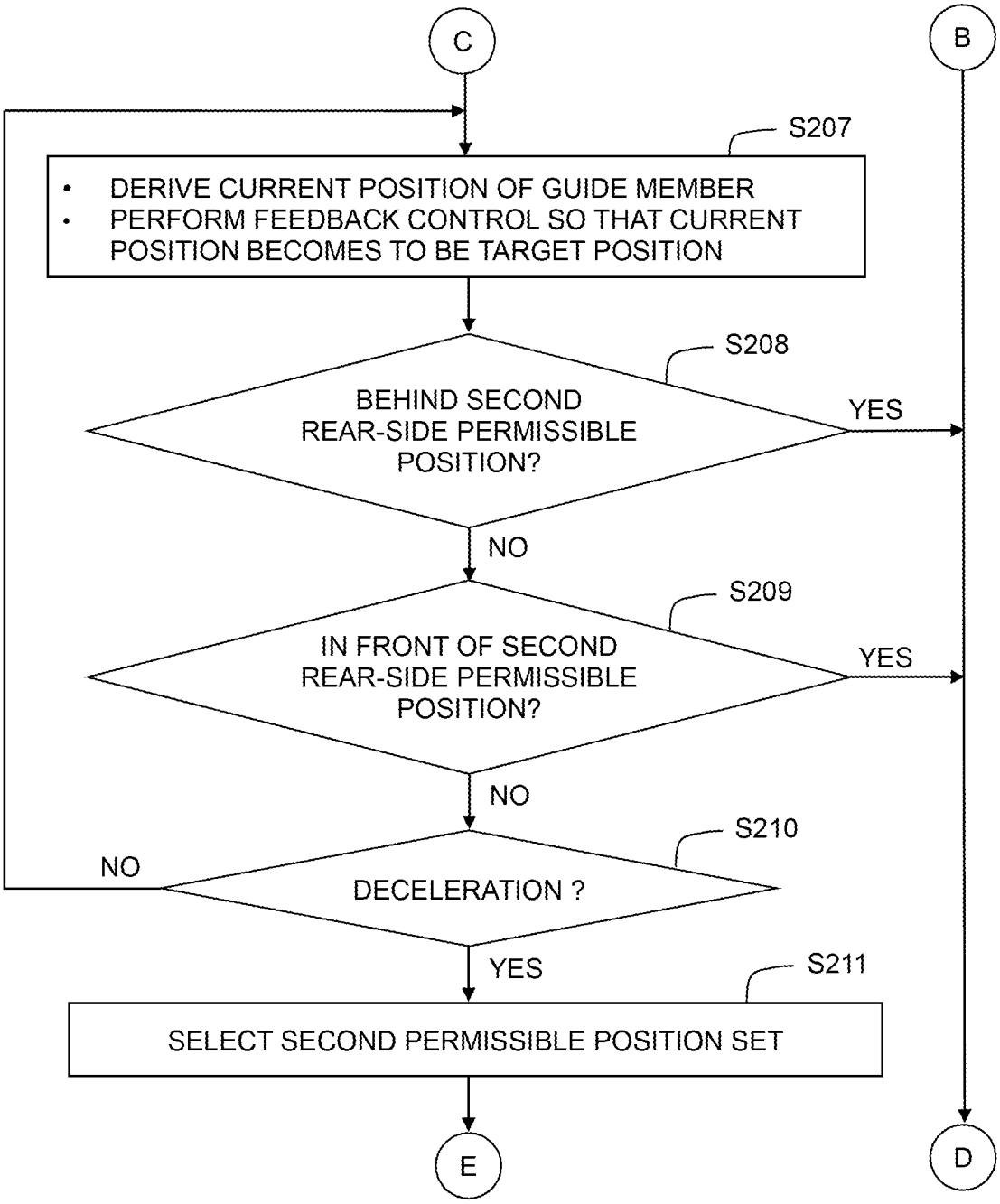
Figure 6C:
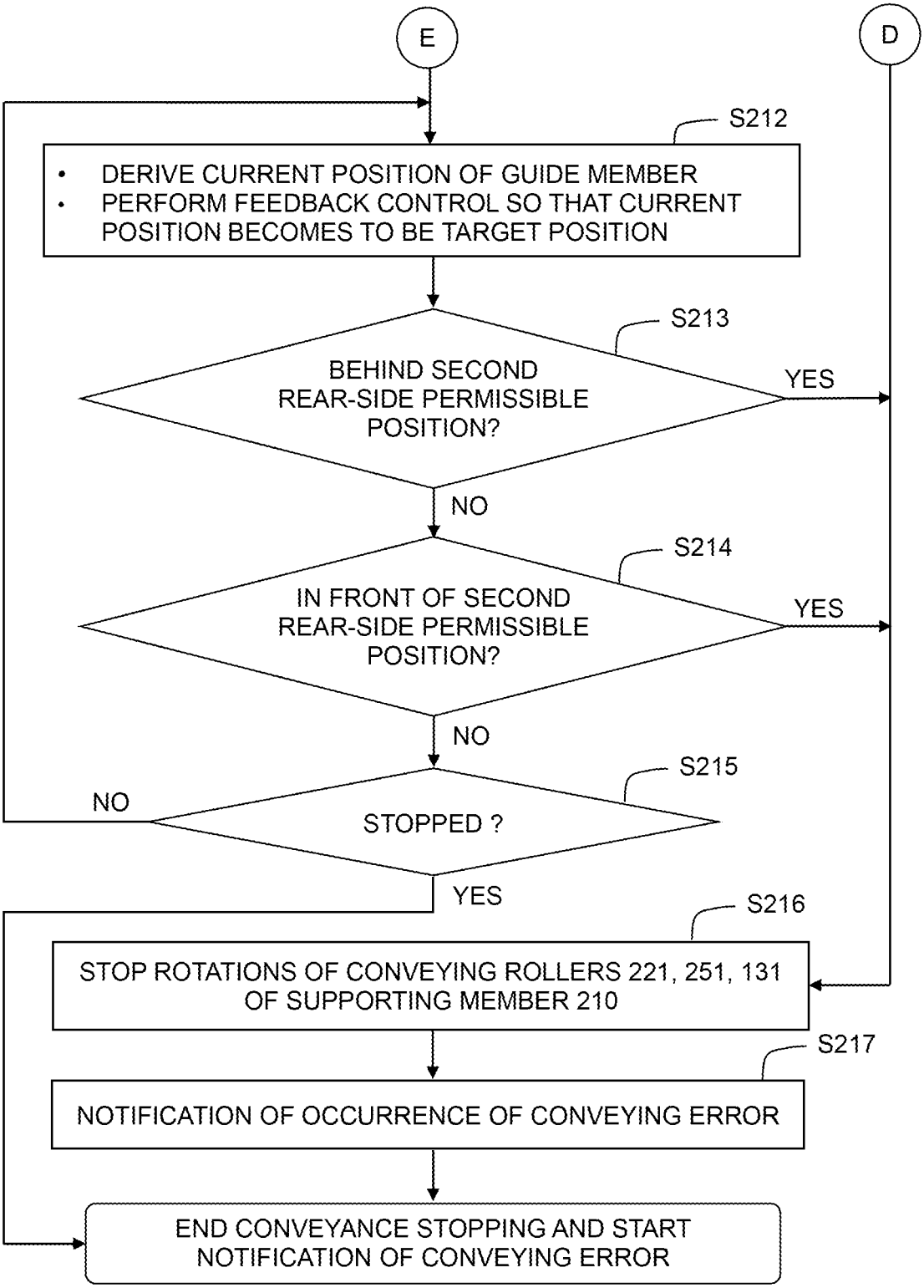

The controller 290 executes a processing of FIGS. 6A to 6C, parallel to the processings of S107 to S109.

In the processing of S201 of FIG. 6A, between the first permissible position set and the second permissible position set, the controller 290 selects the second permissible position set during a period of time from the start of the rotations of the motors 271 and 272 and until the rotations reach the stationary state (namely, during the acceleration). Note that the period of time from the start of the rotations of the motors 271 and 272 and until the rotations reach the stationary state is determined by the driving profile.

In the processing of S202, the controller 290 derives the current position of the guide member 203 with a similar method as that of the processing of S104, at a constant predetermined time interval. In the processing of S202, the controller 290 further performs feedback control for the rotations of the motors 271 and 272 so that the derived current position becomes to be the target position TP determined in the processing of S106. In the feedback control, the controller 290 adjusts the parameter of the driving signal which is to be applied to each of the motors 271 and 272. The parameter is determined depending on the kind of the motors 271 and 272, and is, for example, the pulse width, the amplitude, etc.

In the processing of S203, the controller 290 determines, every time the controller 290 derives the current position, whether or not the derived current position is a position behind the second rear-side permissible position RPP2. In a case that the controller 290 determines that the current position is not the position behind the second rear-side permissible position RPP2 (namely, NO in the processing of S203), the controller 290 executes the processing of S204. In a case that the controller 290 determines that the current position is the position behind the second rear-side permissible position RPP2 (namely, YES in the processing of S203), the controller 290 executes the processing of S216.

In the image recording apparatus 100, there is such a case that the sheet 213 is jammed in the conveying route 160, namely, a jam (jamming) occurs during a period of time in which the rotations of the motors 271 and 272 are being controlled based on the driving profile. In a case that the jam of this kind occurs, there arises such a situation that the sheet 213 is not conveyed in the conveying route 160, which causes the tension by the tensioner to be not applied to the sheet 213. In this situation, the controller 290 determines "YES" in the processing of S203, and the controller 290 executes the processing of S216. Note that regarding this point, similar procedures are performed regarding also the processings of S208 and S213 which will be descried later on.

In the processing of S204, the controller 290 determines whether or not the current position derived in the processing of S202 is a position in front of the second front-side permissible position FPP2. In a case that the controller 290 determines that the current position is not the position in front of the second front-side permissible position FPP2 (namely, in a case that NO in the processing of S204), the controller 290 executes the processing of S205. In a case that the controller 290 determines that the current position is the position in front of the second front-side permissible position FPP2 (namely, in a case that YES in the processing of S204), the controller 290 executes the processing of S216.

In the image recording apparatus 100, the jam might occur also between the supporting member 210 and the guide member 230. In a case that the jam of this kind occurs, there arises such a situation that although the sheet 213 is not conveyed by the supporting member 230 and the conveyance roller pair 220, the conveyance roller pair 220 keeps to feed the sheet 213 to the conveying route 160, which causes an excessive tension to be applied to the sheet 213. In this situation, the controller 290 determines "YES" in the processing of S204, and the controller 290 executes the processing of S216. Note that regarding this point, similar procedures are performed regarding also the processings of S209 and S214 which will be descried later on.

In the processing of S205, the controller 290 determines whether or not the rotations of the motors 271 and 272 are shifted to the stationary state. In a case that the controller 290 determines that the rotations of the motors 271 and 272 are not shifted to the stationary state (namely, in a case that NO in the processing of S205), the controller 290 returns the procedure to the processing of S202. In a case that the controller 290 determines that the rotations of the motors 271 and 272 are shifted to the stationary state (namely, in a case that YES in the processing of S205), the controller 290 executes the processing of S206.

In the processing of S206, the controller 290 selects, between the first permissible position set and the second permissible position set, the first permissible position set.

In the processing of S207, the controller 290 executes a processing similar to that in the processing of S202.

In the processing of S208, the controller 290 determines, every time the controller 290 derives the current position, whether or not the derived current position is a position behind the first rear-side permissible position RPP1. In a case that the controller 290 determines that the current position is not the position behind the first rear-side permissible position RPP1 (namely, NO in the processing of S208), the controller 290 executes the processing of S209. In a case that the controller 290 determines that the current position is the position behind the first rear-side permissible position RPP1 (namely, YES in the processing of S208), the controller 290 executes the processing of S216.

In the processing of S209, the controller 290 determines whether or not the current position derived in the processing of S207 is a position in front of the first front-side permissible position FPP1. In a case that the controller 290 determines that the current position is not the position in front of the first front-side permissible position FPP1 (namely, in a case that NO in the processing of S209), the controller 290 executes the processing of S210. In a case that the controller 290 determines that the current position is the position in front of the first front-side permissible position FPP1 (namely, in a case that YES in the processing of S209), the controller 290 executes the processing of S216.

In the processing of S210, the controller 290 determines whether or not the rotations of the motors 271 and 272 are shifted to the deceleration state. In a case that the controller 290 determines that the rotations of the motors 271 and 272 are not shifted to the deceleration state (namely, in a case that NO in the processing of S210), the controller 290 returns the processing to the processing of S207. In a case that the controller 290 determines that the rotations of the motors 271 and 272 are shifted to the deceleration state (namely, in a case that YES in the processing of S210), the controller 290 executes the processing of S211.

In the processings of S211 to S214, the controller 290 executes processings similar to the processings of S201 to S204. Note that, however, in a case that the controller 290 determines that the current position is not the position in front of the second front-side permissible position FPP2 (namely, in a case that NO in the processing of S214), the controller 290 executes the processing of S215.

In the processing of S215, the controller 290 determines whether or not the rotations of the motors 271 and 272 are stopped. In a case that the controller 290 determines that the rotations of the motors 271 and 272 are not stopped (namely, in a case that NO in the processing of S215), the controller 290 returns the processing to the processing of S212. In a case that the controller 290 determines that the rotations of the motors 271 and 272 are stopped (namely, in a case that YES in the processing of S215), the controller 290 ends the processing of FIGS. 6A to 6C.

In the processing of S216, the controller 290 performs control so as to stop the rotations of the supporting member 210 and the driving rollers 221, 251 and 131. Namely, the controller 290 stops the output of the driving signal to each of the motors 271 and 272. With this, the conveyance of the sheet 213 is stopped. In the processing of S216, the controller 219 further stops the discharge of the ink. In such a manner, the controller 290 ends the image recording processing of FIGS. 4A and 4B.

In the processing of S217, the controller 290 provides a notification that a conveying error of the sheet 213 has occurred. Specifically, the controller 290 causes the display of the operation panel 1110 to display a warning message indicating that the conveying error has occurred, as one of the variety of kinds of information. In addition to this, in a case that the image recording apparatus 100 is provided with a speaker, the controller 290 outputs, from the speaker, a warning sound indicating that the conveying error has occurred.

Action and Effect of Image Recording Apparatus 100 and Conveyer 200

In the image recording apparatus 100, since the permissible position PP in accordance with the target portion TP of the guide member 230 is determined in the processing of S105 of FIG. 4A, any erroneous determination in the processing of FIGS. 6A to 6C that the current position of the guide member 230 exceeds the permissible position PP is suppressed, which result in suppression of any erroneous notification.

In general, in a case that a jam occurs in the inside of the conveyer, the current position of the guide member exceeds the permissible position. In such a situation, there is a case that the permissible position excessively approaches closely to the target position if the target position has been changed and the permissible position is not changed, as in the background art. As a result, in the background art, there is such a problem that the conveying error is notified even though any jam has not occurred. According to the processing of FIGS. 6A to 6C, however, the permissible position PP is appropriately changeable depending on the target position TP, thereby making it possible to suppress any erroneous notification of the conveying error.

Further, as in the background art, in such a situation that only the permissible position is changed, the permissible position becomes to be excessively distant from the target position. As a result, in the background art, there is a case that any excessive time lag occurs from the occurrence of the jam and until the stop of the conveyance. According to the processing of FIGS. 6A to 6C, however, the permissible position PP is appropriately changeable depending on the target position TP, thereby making it possible to stop, as a result, the conveyance of the sheet in a short time from the occurrence of the jam, and to suppress any spreading (worsening) of the jam of the sheet.

According to the processing of FIGS. 6A to 6C, the second rear-side permissible position RPP2 and the second front-side permissible position FPP2 are used for a case that the conveyance roller pair 220 is accelerating or decelerating. The second rear-side permissible position RPP2 is the position behind the first rear-side permissible position RPP1, and the second front-side permissible position FPP2 is the position in front of the first front-side permissible position FPP1. Accordingly, any erroneous determination that the current position of the guide member 230 exceeds the permissible position PP is suppressed, which result in suppression of any erroneous notification.

Further, the sensor 260 is the linear encoder. Furthermore, the movable direction 8 does not include any component in the up-down direction 7. Accordingly, it is possible to suppress the size in the up-down direction 7 of the sensor 260. With this, it is possible to make the height of the image recording apparatus 100 to be small.

Moreover, since the urging member 240 urges the guide member 230 from the front side, it is possible to make the size in the front-rear direction 8 of each of the image recording apparatus 100 and the conveyer 200 to be small, as compared with a case of urging the guide member 230 from the rear side.

Modification

Figure 4B:
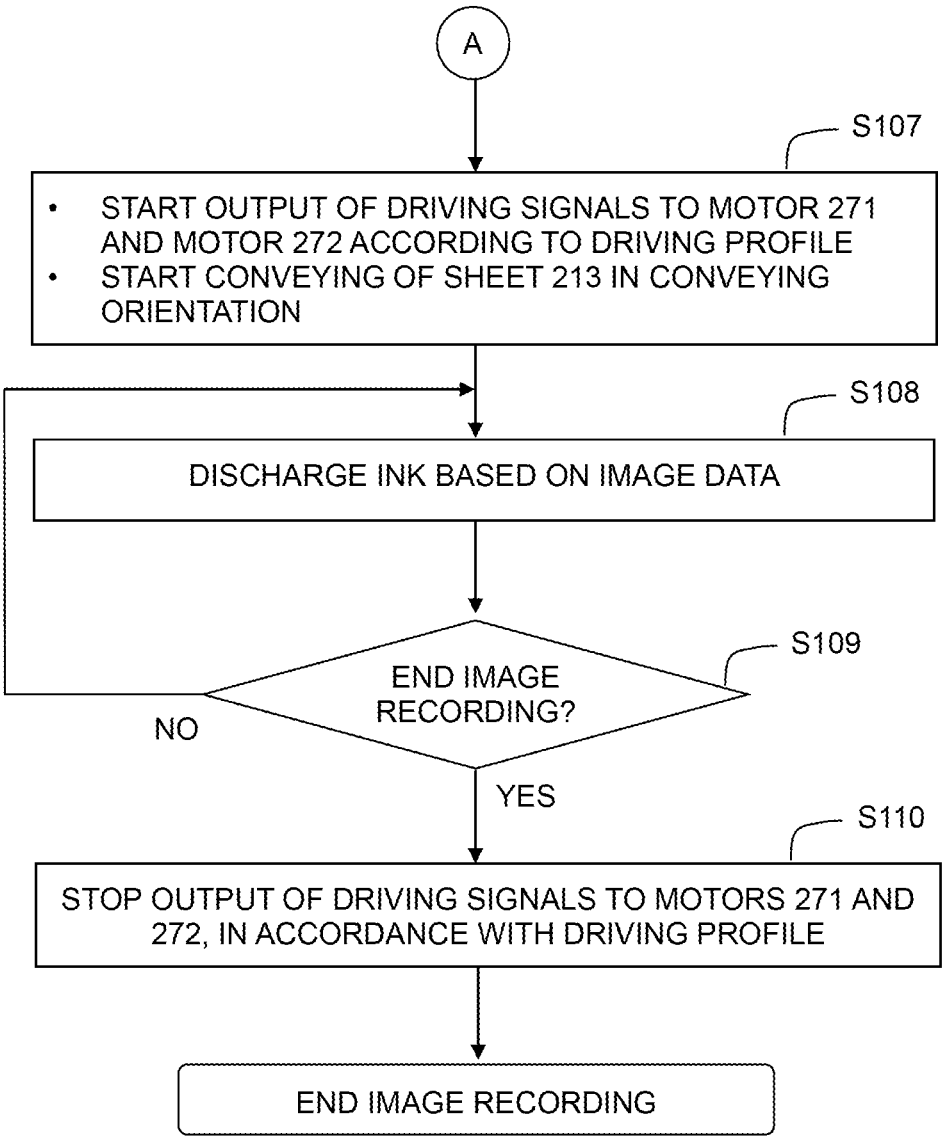

In the embodiment, the sheet 214 is being fed from the roll body 211 during the processings of S107 to S110 of FIG. 4B. As a result, the diameter of the roll body 211 becomes smaller as the time elapses, and the difference from the diameter presumed in the processing of S104 becomes greater as the time elapses.

Figure 7A:
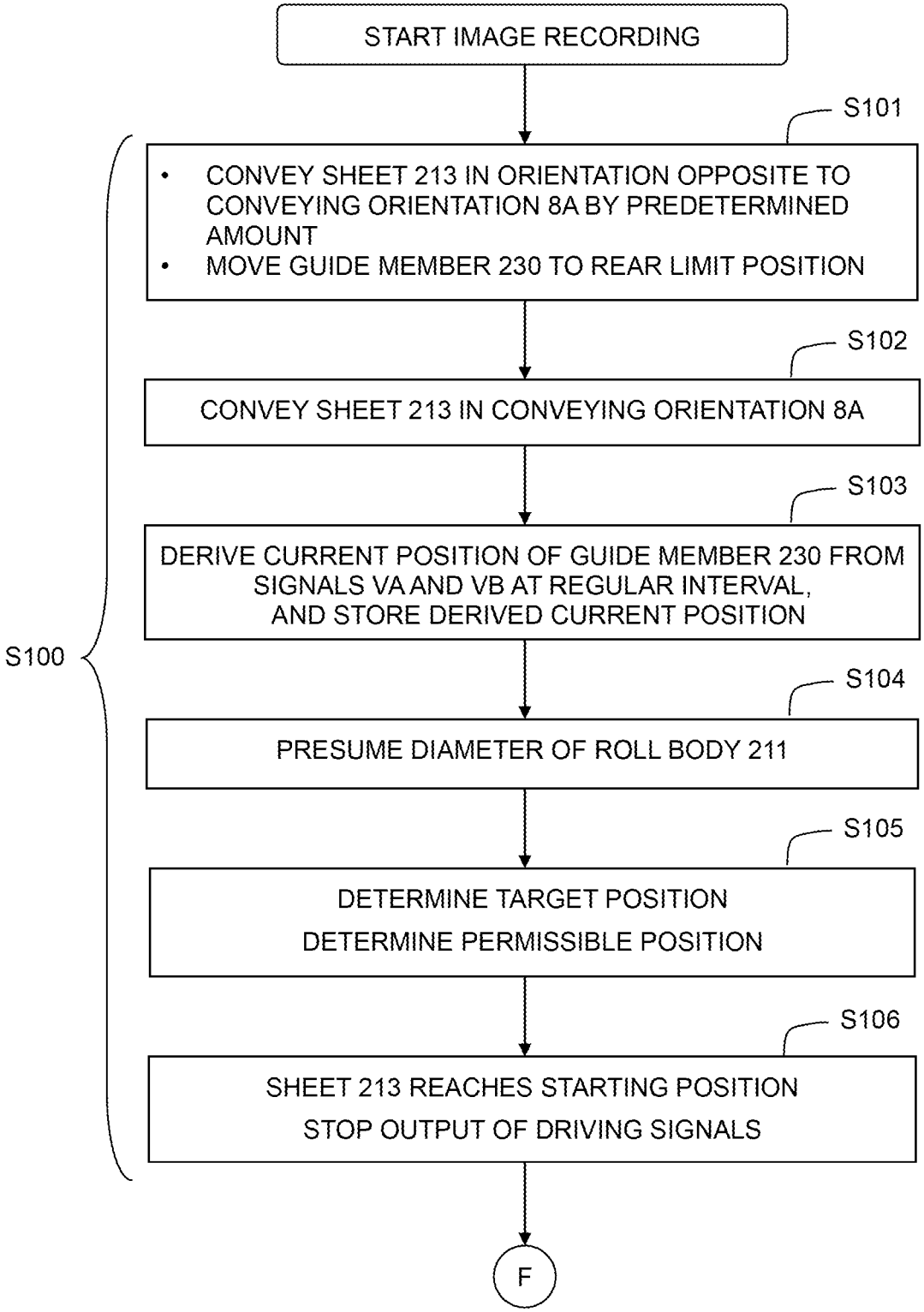
FIGS. 7A and 7B depict a flow chart indicating a processing procedure of an image recording.
Figure 7B:
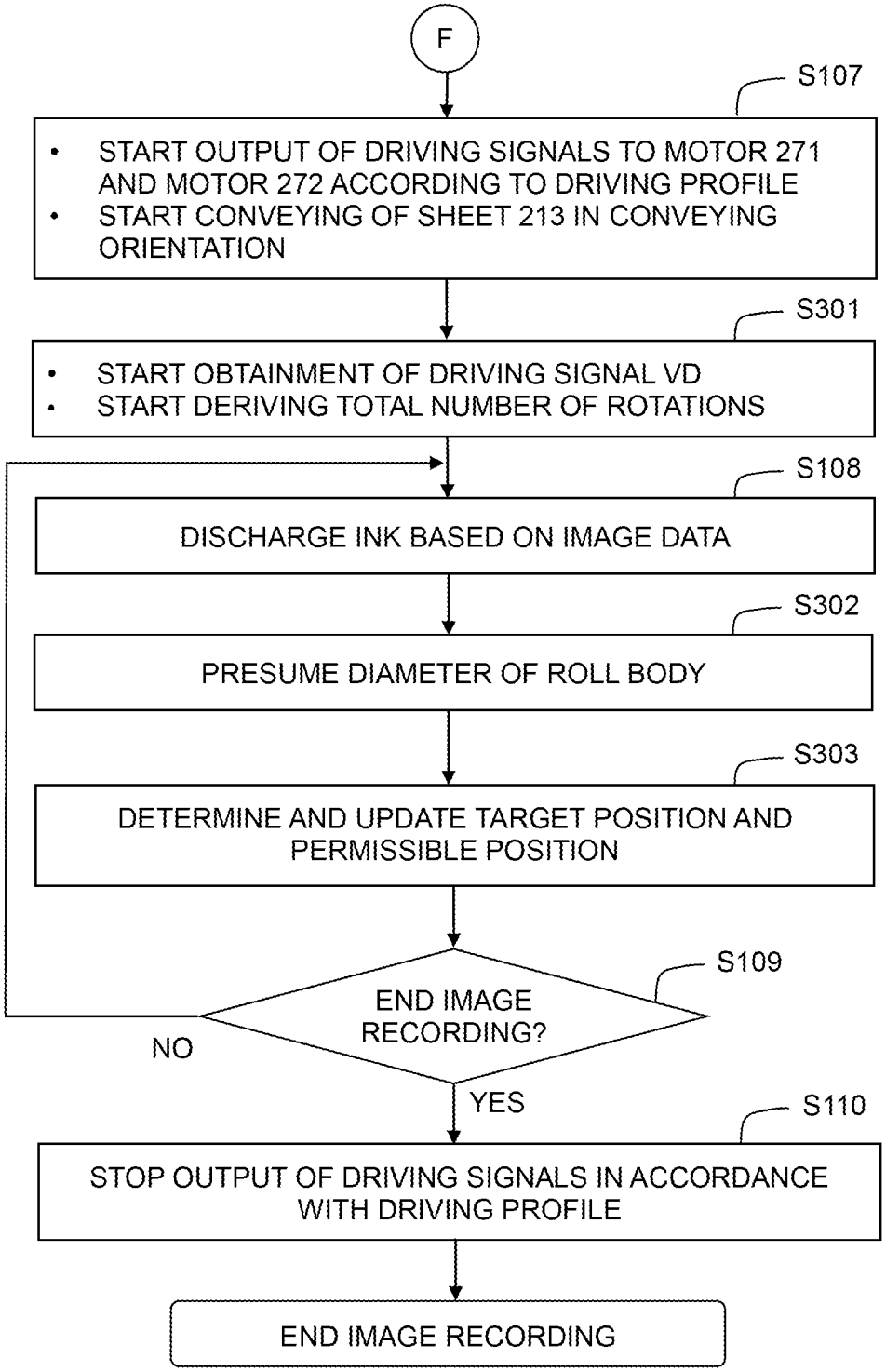

In view of this situation, in an image recording apparatus 100 according to a modification, the controller 290 executes an image recording as depicted in FIGS. 7A and 7B. In the following, in a case of comparing the image recording of FIGS. 7A and 7B with the image recording of FIGS. 4A and 4B, the image recording of FIGS. 7A and 7B is different from the image recording of FIGS. 4A and 4B that the image recording of FIGS. 7A and 7B includes the processing of S301 between the processing of S107 and the processing of S108 and includes the processings of S302 and S303 between the processing of S108 and the processing of S109. Accordingly, in the following explanation, the difference between the image recording of FIGS. 7A and 7B and the image recording of FIGS. 4A and 4B will be explained.

After the execution of the processing of S107, in the processing of S301, the controller 290 starts obtaining the signal Vd from the rotary encoder 281 and starts deriving a total number of rotations of the supporting member 210 based on the signal Vd. The total number of rotations is a number of the rotations of the supporting member 210 since the processing of S301.

After the execution of the processing of S108, the controller 290 presumes, in the processing of S302, a current diameter of the roll body 211 based on that (responding to that) an update timing for the diameter of the roll body 211 has arrived. The total thickness of the separator and the labels in the roll body 211 is previously determined. Accordingly, the controller 290 deducts, from the diameter of the roll body 211 presumed last time, a multiplied value of the total number of rotations, the total thickness and 2 (two) to thereby derive the current diameter of the roll body 211.

Next, in the processing of S303, the controller 290 determines a target position TP corresponding to the current diameter of the roll body 211, in a similar manner as in the processing of S105. The controller 290 further determines four permissible positions PP (see FIG. 5B). The controller 290 updates the target position TP and the four permissible positions PP stored in the RAM, etc., to the target position TP and the four permissible positions PP determined in the processing of S303.

Note that in such a case that the updating timing of the diameter of the roll body 211 has not arrived after the execution of the processing of S108, the processings of S202 and S203 are skipped.

Action and Effect of Modification

According to the image recording processing of the modification, the target position TP and the four permissible positions PP are updated, depending on the current diameter of the roll body 211, during the execution of image recording. Thus, it is possible to further suppress any erroneous determination that the current position of the guide member 230 exceeds the permissible position PP in the processing of FIGS. 6A to 6C.

Other Modifications

In the embodiment, in the processings of S201 and S211, both the second rear-side permissible position RPP2 and the second front-side permissible position FPP2 are selected. The present disclosure, however, is not limited to this; in the processing of S211, it is allowable to select, between the second rear-side permissible position RPP2 and the second front-side permissible position FPP2, only the second front-side permissible position FPP2 in a case that the suppression of the erroneous determination of the conveying error due to the overshoot of the motors 271 and 272 is regarded important. In this case, the processing of S203 is not executed. Alternatively, in a case that the suppression of the erroneous determination of the conveying error due to the undershoot of the motors 271 and 272 is regarded important, it is allowable to select only the second rear-side permissible position RPP2 in the processing of S211. In this case, the processing of S213 is not executed.

In the embodiment, both the first rear-side permissible position RPP1 and the first front-side permissible position FPP1 are selected in the processing of S206. The present disclosure, however, is not limited to this; it is allowable to select any one of the first rear-side permissible position RPP1 and the first front-side permissible position FPP1 in the processing of S206.

In the embodiment, the image recording apparatus 100 records an image on the sheet 213 by the ink-jet recording system. The system of image recording is not limited to the ink-jet recording system, and may be, for example, an electrophotographic system, a thermal transfer system, etc. Further, regarding the thermal transfer system, there is a direct printer in which a recording head is directly brought into contact with the sheet. In the direct printer, there is not any conveyance roller pair on the upstream side in the conveying direction 8 of the recording head, and a conveying belt (another example of the "conveyance roller") is provided immediately below the recording head.

In the embodiment, the sensor 260 is the linear encoder. The present disclosure, however, is not limited to this. The sensor 260 may be a rotary encoder. In this case, the guide member 230 is consequently such a type that rocks (pivots) about the rotation axis thereof. The guide member of the rocking type is provided with; a lever member which rockably supports a lower end part of the guide member about a rotation axis L extending parallel to the width direction of the sheet, and a roller attached rotatably to a upper end part of the lever member. The lever member is urged rearward by a coil spring.

In the embodiment, the image recording apparatus 100 is provided with the conveying/supporting mechanism 130 which applies the conveying force to the sheet 213. It is allowable, however, that the image recording apparatus 100 is provided with a platen which is configured only to support the platen 213, rather than the conveying/supporting mechanism 130.

In the embodiment, the processing in FIGS. 6A to 6C includes both the processings of S216 and S217. The present disclosure, however, it not limited to this; it is allowable that either one of the processing of S216 and the processing of S217 is executed.

In the embodiment and the modification, the diameter of the roll body 211 is presumed in the processing of S104 of FIG. 4A, in the processing of S104 of FIG. 7A and in the processing of S302 of FIG. 7B. However, since the diameter of the roll body 211 correlates to a conveying amount of conveyance (of the sheet 213) by the conveyance roller pair 220 in the conveying direction 8, it is allowable that the controller 290 derives the conveying amount of the sheet 213 by the conveyance roller pair 220 in the processing S104 of FIG. 4A, in the processing of S104 of FIG. 7A and in the processing of S302 of FIG. 7B, and that the controller 290 determines a target position and a permissible position in accordance with the derived conveying amount, in the processing of S105 of FIG. 4A, in the processing of S105 of FIG. 7A and in the processing of S303 of FIG. 7B. The conveying amount of the conveyance roller pair 220 can be substituted with a conveying amount of the discharge roller pair 250. Further, other than this, since the diameter of the roll body 211 correlates also to a number of the labels on which the recording head 140 records an image, it is allowable that the controller 290 derives the number of the labels on which the recording head 140 records the image in the processing of S104 of FIG. 4A, in the processing of S104 of FIG. 7A and in the processing of S302 of FIG. 7B, and that the controller 290 determines a target position and a permissible position in accordance with the derived number of the labels, in the processing of S105 of FIG. 4A, in the processing of S105 of FIG. 7A and in s the processing of S303 of FIG. 7B.

What is claimed is:

1. A conveyer comprising:

A support configured to rotate in a state that the support supports a roll body in which a roll sheet is wound;

a conveyance roller configured to convey the sheet pulled from the roll body in a conveying orientation;

a guide positioned upstream in the conveying orientation of the conveyance roller, configured to make contact with the sheet pulled from the roll body, and configured to move in a crossing direction crossing an axis of the support and an axis of the conveyance roller;

an urging member configured to urge the guide in an urging direction including a component in the crossing direction so as to apply a tension to the sheet making contact with the guide;

a sensor configured to detect a position in the crossing direction of the guide; and a controller configured to control rotation of the support and rotation of the conveyance roller, wherein the controller is configured to execute:

determination of a target position in the crossing direction of the guide member in accordance with a diameter of the roll body, and determination of a permissible position in accordance with the determined target position;

controlling of a rotation amount of the support, a rotation amount of the conveyance roller, or both of the rotation amount of the support and the rotation amount of the conveyance roller such that the position in the crossing direction of the guide becomes to be the determined target position;

determination as to whether or not the position in the crossing direction of the guide detected by the sensor exceeds the permissible position; and performing of a notification of a conveying error of the sheet in accordance with determination by the controller that the position in the crossing direction of the guide exceeds the permissible position, the controller is configured:

to perform the notification in a case that the controller controls the conveyance roller to rotate the conveyance roller in a constant speed; and not to perform the notification in a case that the controller controls the conveyance roller to rotate such that rotation of the conveyance roller is accelerated or decelerated, even though the position in the crossing direction of the guide exceeds the permissible position.

2. The conveyer according to claim 1, wherein the permissible position includes a first permissible position and a second permissible position for each of which the target position is a reference thereof, the first permissible position is a position farther from the second permissible position with the target position as the reference, and the controller is configured:

to perform the notification in a case that the controller controls the conveyance roller to rotate such that rotation of the conveyance roller is accelerated or decelerated and that the position in the crossing direction of the guide detected by the sensor exceeds the first permissible position; and to perform the notification in a case that the controller controls the conveyance roller to rotate in a constant speed and that the position in the crossing direction of the guide detected by the sensor exceeds the second permissible position.

3. The conveyer according to claim 1, wherein the crossing direction and the urging direction are directions which are parallel to each other, and the sensor is a liner encoder.

4. The conveyer according to claim 1, wherein the urging direction includes a component opposite to the conveying orientation.

5. The conveyer according to claim 1, wherein the conveyance roller configured to convey the sheet pulled from the roll body in the conveying orientation is provided on an area which is different from a location between the guide and the support.

6. An image recording apparatus comprising:

the conveyer as defined in claim 1; and a recording head configured to record an image on the sheet conveyed by the conveyer.

7. A conveyer comprising:

a support configured to rotate in a state that the support supports a roll body in which a roll sheet is wound;

a conveyance roller configured to convey the sheet pulled from the roll body in a conveying orientation;

a guide positioned upstream in the conveying orientation of the conveyance roller, configured to make contact with the sheet pulled from the roll body, and configured to move in a crossing direction crossing an axis of the support and an axis of the conveyance roller;

an urging member configured to urge the guide in an urging direction including a component in the crossing direction so as to apply a tension to the sheet making contact with the guide;

a sensor configured to detect a position in the crossing direction of the guide; and a controller configured to control rotation of the support and rotation of the conveyance roller, wherein the controller is configured to execute:

determination of a target position in the crossing direction of the guide in accordance with a diameter of the roll body, and determination of a permissible position in accordance with the determined target position;

controlling of a rotation amount of the support, a rotation amount of the conveyance roller, or both of the rotation amount of the support and the rotation amount of the conveyance roller so that the position in the crossing direction of the guide becomes to be the determined target position;

determination as to whether or not the position in the crossing direction of the guide detected by the sensor exceeds the permissible position; and stopping of rotation of the support and rotation of the conveyance roller in accordance with determination by the controller that the position in the crossing direction of the guide exceeds the permissible position;

determination of the permissible position such that a distance allowing the guide to move in a case that the controller controls the conveyance roller to rotate such that rotation of the conveyance roller is accelerated or decelerated is longer than a distance allowing the guide to move in a case that the controller controls the conveyance roller to rotate the conveyance roller in a constant speed.

8. A conveyer comprising:

a support configured to rotate in a state that the support supports a roll body in which a roll sheet is wound;

a conveyance roller configured to convey the sheet pulled from the roll body in a conveying orientation;

a guide positioned upstream in the conveying orientation of the conveyance roller, configured to make contact with the sheet pulled from the roll body, and configured to move in a crossing direction crossing an axis of the support and an axis of the conveyance roller;

an urging member configured to urge the guide in an urging direction including a component in the crossing direction so as to apply a tension to the sheet making contact with the guide;

a sensor configured to detect a position in the crossing direction of the guide; and a controller configured to control rotation of the support and rotation of the conveyance roller, wherein the controller is configured to execute:

determination of a target position in the crossing direction of the guide in accordance with a diameter of the roll body, and determination of a permissible position in accordance with the determined target position;

controlling of a rotation amount of the support, a rotation amount of the conveyance roller, or both of the rotation amount of the support and the rotation amount of the conveyance roller such that the position in the crossing direction of the guide becomes to be the determined target position;

determination as to whether or not the position in the crossing direction of the guide detected by the sensor exceeds the permissible position;

performing of a notification of a conveying error of the sheet in accordance with determination by the controller that the position in the crossing direction of the guide exceeds the permissible position; and determination of the permissible position such that a distance allowing the guide to move in a case that the controller controls the conveyance roller to rotate such that rotation of the conveyance roller is accelerated or decelerated is longer than a distance allowing the guide to move in a case that the controller controls the conveyance roller to rotate the conveyance roller in a constant speed.

* * * * *